US008992246B2

(12) United States Patent
Tian et al.

(10) Patent No.: US 8,992,246 B2
(45) Date of Patent: Mar. 31, 2015

(54) CIRCUIT BOARD CONNECTOR AND METHOD FOR CONNECTING CIRCUIT BOARD

(75) Inventors: Xiyong Tian, Beijing (CN); Lingchang Li, Beijing (CN); Yinong Liu, Beijing (CN)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 331 days.

(21) Appl. No.: 13/546,499

(22) Filed: Jul. 11, 2012

(65) Prior Publication Data

US 2013/0017700 A1 Jan. 17, 2013

(30) Foreign Application Priority Data

Jul. 15, 2011 (CN) ..... 2011 1 0198715

(51) Int. Cl.
*H01R 12/24* (2006.01)
*H01R 12/88* (2011.01)

(52) U.S. Cl.
CPC ..... *H01R 12/88* (2013.01)
USPC ..... 439/331

(58) Field of Classification Search
CPC ..... H01R 12/88
USPC ..... 439/260, 495
See application file for complete search history.

(56) References Cited

U.S. PATENT DOCUMENTS 3,149,896 A * 9/1964 Hall ..... 439/329
4,080,037 A * 3/1978 Kunkle et al. ..... 439/853
4,235,500 A * 11/1980 Belopavlovich et al. ..... 439/495
4,630,874 A * 12/1986 Renn et al. ..... 439/263
4,639,063 A * 1/1987 Mueller ..... 439/325
4,761,140 A * 8/1988 Geib ..... 439/71
4,778,403 A * 10/1988 Ikesugi et al. ..... 439/329
4,936,792 A * 6/1990 Onoue et al. ..... 439/329
4,944,690 A * 7/1990 Imai ..... 439/492
4,948,378 A * 8/1990 Hoshino ..... 439/271

(Continued)

FOREIGN PATENT DOCUMENTS

CN 1326246 A 12/2001

OTHER PUBLICATIONS

Extended European Search Report corresponding to European Application No. 12176408.8 filed Jul. 13, 2012.

(Continued)

*Primary Examiner* — Neil Abrams
(74) *Attorney, Agent, or Firm* — Renner, Otto, Boisselle & Sklar, LLP.

(57) ABSTRACT

A circuit board connector and a method for connecting circuit board. The circuit board connector includes: a housing, including a left side wall and right side wall opposite each other and a bottom wall arranged between the left and right side walls, the bottom wall provided with a plurality of contact pins, and the left and right side walls and the bottom wall forming an accommodation space for accommodating the circuit board; a cover, one end being connected to the housing, so that the cover may be opened or closed relative to the housing; and a locking device arranged on the housing and cover to lock the cover when the cover is closed. Reliable connection of the circuit board can be realized, without a gasket or a film, and also the circuit board can be locked firmly, preventing the rebounding of the hinge of the connector.

15 Claims, 8 Drawing Sheets

(56) References Cited

U.S. PATENT DOCUMENTS

| | | | | |
|---|---|---|---|---|
| 5,356,308 | A * | 10/1994 | Toba et al. | 439/495 |
| 5,695,359 | A * | 12/1997 | Fujikura et al. | 439/495 |
| 6,267,620 | B1 * | 7/2001 | Ma | 439/495 |
| 6,299,469 | B1 * | 10/2001 | Glovatsky et al. | 439/329 |
| 6,338,648 | B1 * | 1/2002 | Miura et al. | 439/495 |
| 6,431,887 | B1 * | 8/2002 | Yeomans et al. | 439/108 |
| 6,431,907 | B1 * | 8/2002 | Ma | 439/495 |
| 6,533,606 | B2 * | 3/2003 | Yamane | 439/495 |
| 6,612,859 | B2 | 9/2003 | Yeomans et al. | |
| 6,733,326 | B2 * | 5/2004 | Lee | 439/495 |
| 6,890,203 | B2 * | 5/2005 | Matsunaga et al. | 439/331 |
| 7,118,419 | B1 * | 10/2006 | Lee | 439/630 |
| 7,387,528 | B2 * | 6/2008 | Lee et al. | 439/495 |
| 7,500,869 | B2 * | 3/2009 | Wang | 439/495 |
| 7,520,774 | B2 * | 4/2009 | Watanabe | 439/493 |
| 8,616,906 | B2 * | 12/2013 | Iijima et al. | 439/260 |
| 2005/0095893 | A1 | 5/2005 | Zheng et al. | |
| 2006/0292910 | A1 | 12/2006 | Lee et al. | |
| 2007/0298628 | A1 | 12/2007 | Suzuki | |
| 2008/0286999 | A1 | 11/2008 | Wang | |

OTHER PUBLICATIONS

First Chinese Office Action, corresponding to CN201110198715.9, filed Jul. 15, 2011 in Chinese language, along with Associate's report letter of Apr. 17, 2014.

* cited by examiner

CIRCUIT BOARD CONNECTOR AND METHOD FOR CONNECTING CIRCUIT BOARD

TECHNICAL FIELD

The present invention relates to a circuit board connector, and in particular to a circuit board connector having a locking structure and a method for connecting a circuit board.

BACKGROUND ART

As communication technologies develop, mobile communication devices and personal terminal equipment, such as a mobile phone, a personal digital assistant (PDA) and MP3/MP4, etc., are widely used. The signal connection or transmission between the functional modules of these devices, or between these modules and external devices, is realized by flexible printed circuit (FPC) board connectors.

For example, an existing mobile phone usually comprises a housing, a communication module, a man-machine interface and a power supply module, wherein the communication module is provided within the housing, and the man-machine interface usually includes a liquid crystal display screen, etc. arranged on the housing and electrically connected to the main circuit board via the FPC connector.

FIG. 1 is a schematic diagram showing the state where a FPC connector 100 and a FPC board of the prior art are not completely connected. As shown in FIG. 1, the FPC connector includes an insulated housing 101 and a cover 102, an accommodation space 100*a* being formed in the insulated housing 101, several terminals 103 being provided on the cover 102, and each of the terminals having a contact portion. The FPC board (not shown) may be connected to the FPC connector through extending into the accommodation space, and the conductive pins 104 on the FPC board may correspond to the terminals 103 on the cover 102. The cover 102 is of a hinge structure, with pivots being provided at the two sides and pivoted to the axis holes of the insulated housing 101, hence the cover 102 may be opened or closed relative to the insulated housing 101.

FIG. 2 is a schematic diagram showing the state where a FPC connector 100 and a FPC board of the prior art are completely connected. As shown in FIG. 2, after an end of the FPC board extends into the accommodation space of the insulated housing 101, the cover 102 may be pivoted and closed relative to the insulated housing 101, so as to press against the FPC board, causing the conductive pins 104 on the FPC board to be in contact with the terminals 103 on the cover 102.

SUMMARY OF THE INVENTION

In the implementation of the present invention, the applicant found that following defect exists in the prior art: the FPC board of such a hinge structure needs to add a gasket or a film on the top to prevent hinge rebounding (i.e. not firmly locked). However, the existence of the gasket or a film may lead to unreliable contact of the conductive pins and an issue of connection of the FPC, and such an issue of connection of the FPC is even worse especially in cases of abnormal use, such as drop of the devices.

The embodiments of the present invention provide a circuit board connector having a locking structure and a method for connecting circuit board, with the object being to realize reliable connection of the circuit board by locking firmly the circuit board connector.

According to an aspect of the embodiments of the present invention, there is provided a circuit board connector, including:

a housing, including a left side wall and a right side wall opposite to each other and a bottom wall arranged between the left and right side walls, the bottom wall being provided with a plurality of contact pins, and the left and right side walls and the bottom wall forming an accommodation space for accommodating the circuit board;

a cover, one end of which being connected to the housing, so that the cover may be opened or closed relative to the housing; and a locking device arranged on the housing and the cover, the locking device locking the cover when the cover is closed.

According to another aspect of the embodiments of the present invention, the cover includes a left side wall and a right side wall opposite to each other and a top wall arranged between the left and right side walls, and pivots are arranged at the left and right side walls of the cover, pivot holes are arranged at the left and right side walls of the housing, and the cover is connected to the housing via the pivots and pivot holes.

According to still another aspect of the embodiments of the present invention, the locking device includes:

a locking hole arranged at an end of the cover opposite to the pivots and positioned on the left and right side walls of the cover; and a locking block arranged at another end of the cover opposite to the pivot holes and positioned on the left and right side walls of the housing.

According to still a further aspect of the embodiments of the present invention, the cover has ribs at the top wall.

According to still a further aspect of the embodiments of the present invention, there are guiding holes on the left and right side walls of the housing.

According to still a further aspect of the embodiments of the present invention, one end of a contact pin has a convex structure.

According to still a further aspect of the embodiments of the present invention, the convex structure includes an arc convex or a semi-circular convex, and the size of the arc convex is different from that of the semi-circular convex.

According to still a further aspect of the embodiments of the present invention, the contact pins having the arc convex and the contact pins having the semi-circular convex are arranged in an alternating way.

According to still a further aspect of the embodiments of the present invention, the circuit board connector further includes:

guiding slots arranged on the left and right side walls of the housing and being in communication with the pivot holes, the cover being slidable along the guiding slots via the pivots.

According to still a further aspect of the embodiments of the present invention, there is provided a method for connecting a circuit board, using the circuit board connector as stated above, the method for connecting including:

an extending step: extending the circuit board into an accommodation space of the circuit board connector, the conductive pins of the circuit board corresponding to the contact pins of the circuit board connector;

a closing step: closing a cover of the circuit board connector to make the cover press downwards, such that the conductive pins and the contact pins are in contact and electrically connected; and a locking step: locking the cover by a locking device of the circuit board connector.

According to still a further aspect of the embodiments of the present invention, before the extending step, the method further includes:

an opening step: opening the cover to expose the accommodation space, such that the circuit board extends into the accommodation space.

According to still a further aspect of the embodiments of the present invention, the locking step includes: embedding a locking block of the locking device into the locking hole of the locking device, so as to lock the cover.

According to still a further aspect of the embodiments of the present invention, the closing step further includes: buckling the circuit board by the ribs on the cover.

According to still a further aspect of the embodiments of the present invention, the closing step further includes: fixing the circuit board by the guiding holes on the housing of the circuit board connector, in order to prevent the circuit board from moving.

According to still a further aspect of the embodiments of the present invention, after the closing step, the method for connecting further includes:

an unlocking step: unlocking the cover, so as to open the cover and eject the circuit board.

According to still a further aspect of the embodiments of the present invention, the unlocking step includes: pushing the cover, and the cover sliding along guiding slots arranged on the housing of the circuit board connector, such that the locking block of the locking device disengages from the locking hole of the locking device to unlock the cover.

Advantages of the present invention exist in that with the circuit board connector having a locking structure, not only reliable connection of the circuit board can be realized without adding a gasket or a film, but also can lock firmly the circuit board, preventing the rebounding of the hinge of the connector.

These and further aspects and features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "includes/including" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment.

BRIEF DESCRIPTION OF THE DRAWINGS

The drawings are included to provide further understanding of the present invention, which constitute a part of the specification and illustrate the preferred embodiments of the present invention, and are used for setting forth the principles of the present invention together with the description. The same element is represented with the same reference number throughout the drawings. In some instances different reference numerals designate the same element in different drawing figures, e.g., left side wall that is 300L in FIG. 3 is 701 in FIG. 7.

In the drawings.

DETAILED DESCRIPTION OF THE INVENTION

The interchangeable terms "electronic apparatus" and "electronic device" include portable radio communication apparatus. The term "portable radio communication apparatus", which hereinafter is referred to as a "mobile terminal", "portable electronic device", or "portable communication device", includes all apparatuses such as mobile telephones, pagers, communicators, electronic organizers, personal digital assistants (PDAs), smartphones, portable communication devices or the like.

In the present application, embodiments of the invention are described primarily in the context of a portable electronic device in the form of a mobile telephone (also referred to as "mobile phone"). However, it shall be appreciated that the invention is not limited to the context of a mobile telephone and may relate to any type of appropriate electronic apparatus having the function of photographing and sound recording.

The preferred embodiments of the present invention are described as follows in reference to the drawings.

In the embodiments of the present invention, the circuit board connector may be a flexible printed circuit (FPC) board connector, and the circuit board may be a flexible printed circuit (FPC) board, but they are not limited thereto, and other circuit board connectors may be applicable in particular implementations. The following description is given taking an FPC connector as an example.

Preferred embodiments of the present invention will be described below with reference to the drawings.

Figure 1:
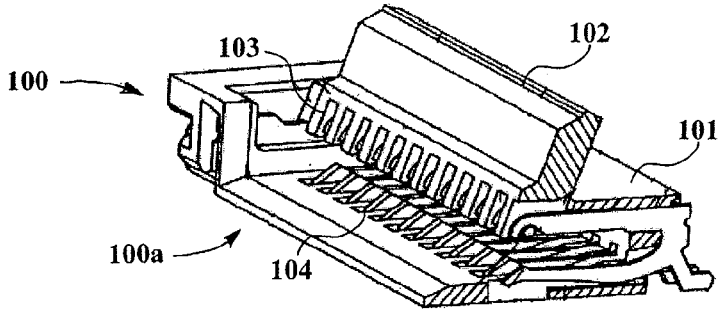
FIG. 1 is a schematic diagram showing the state where a FPC connector and a FPC board of the prior art are not completely connected.
Figure 2:
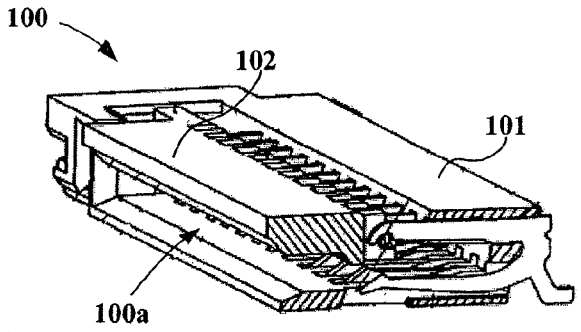
FIG. 2 is a schematic diagram showing the state where a FPC connector and a FPC board of the prior art are completely connected.
Figure 3:
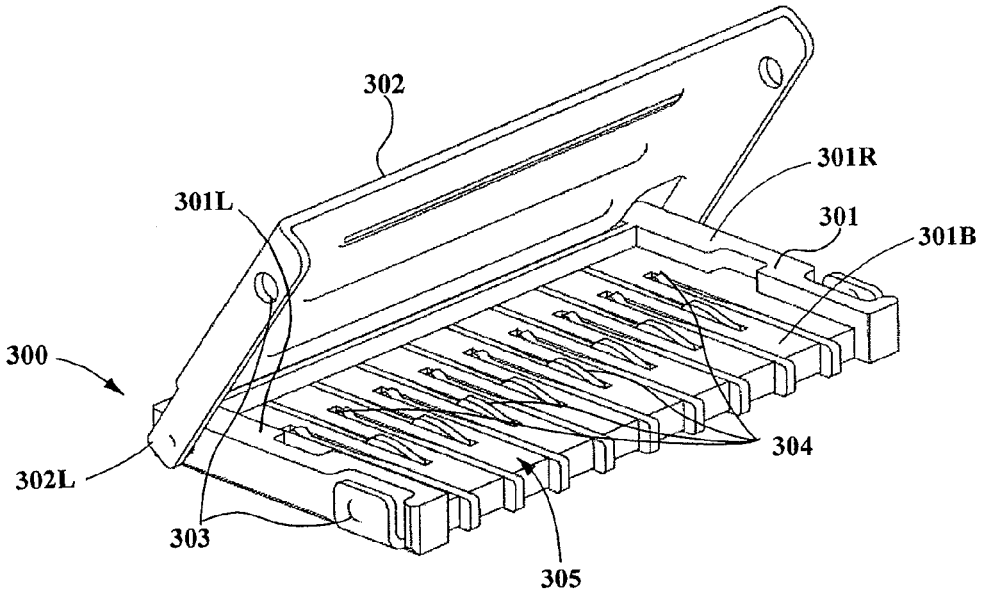
FIG. 3 is schematic diagram of the circuit board connector of an embodiment of the present invention when the cover is opened.

The embodiments of the present invention provide a circuit board connector. FIG. 3 is a schematic diagram of the circuit board connector 300 of an embodiment of the present invention when the cover is opened. As shown in FIG. 3, the circuit board connector includes: a housing 301, a cover 302 and a locking device 303.

The housing 301 includes a left side wall 301L and a right side wall 301R opposite to each other and a bottom wall arranged between the left and right side walls, the bottom wall 301B being provided with a plurality of contact pins 304 (only schematically shown in the figure), and the left and right side walls and the bottom wall forming an accommodation space 305 for accommodating the circuit board.

One 302-1 end of the cover 302 is connected to the housing 301, so that the cover 302 may be opened or closed relative to the housing 301.

The locking device 303 is arranged on the housing 301 and the cover 302, the locking device 303 locks the cover 302 when the cover 302 is closed.

In implementation, the housing 301 may be an insulated housing, and the cover 302 may be a metal cover.

Figure 4:
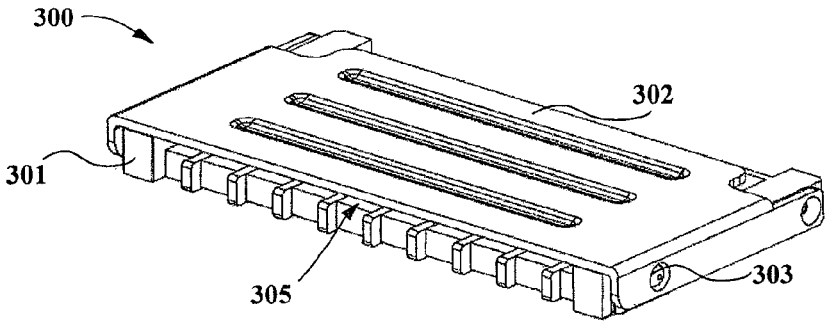
FIG. 4 is schematic diagram of the circuit board connector of an embodiment of the present invention when the cover is closed.
Figure 5:
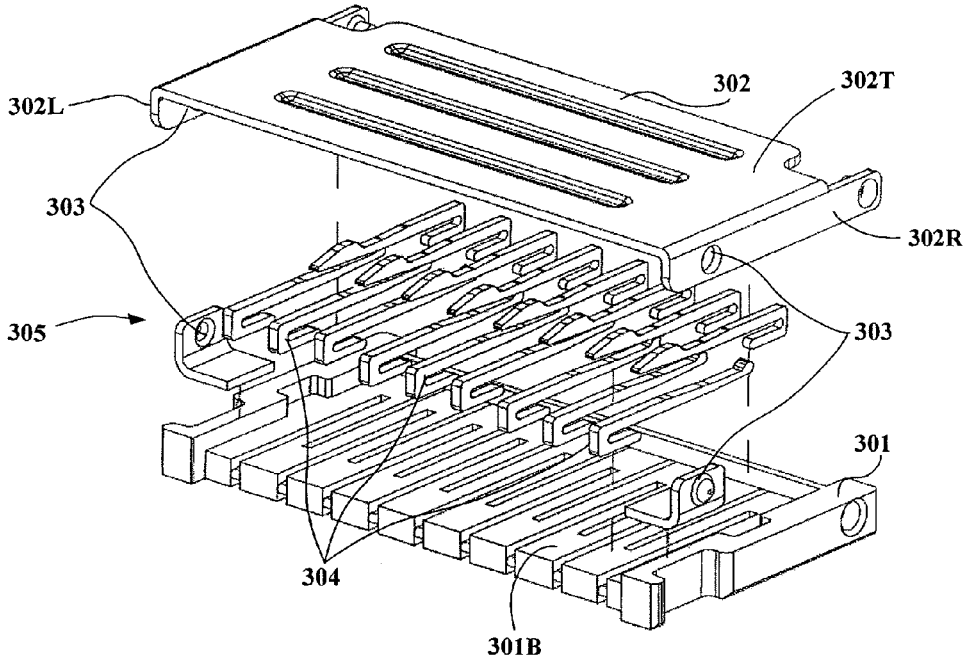
FIG. 5 is a perspective exploded view of the circuit board connector of an embodiment of the present invention.

FIG. 4 is schematic diagram of the circuit board connector 300 of an embodiment of the present invention when the cover is closed, and FIG. 5 is a perspective exploded view of the circuit board connector of an embodiment of the present invention. As shown in FIGS. 4 and 5, after the circuit board (not shown) extends into the accommodation space 305 of the circuit board connector and the cover 302 is closed, the cover 302 may be locked by the locking device 303. Thus, not only reliable connection of the conductive pins can be ensured, but also the circuit board connector 300 can lock firmly the circuit board, preventing the rebounding of the hinge of the connector.

In an embodiment, the cover 302 may include a left side wall 302L and a right side wall 302R opposite to each other and a top wall 302T arranged between the left and right side walls. Pivots, which are described further below, are arranged at one end of the left and right side walls of the cover 302, pivot holes are arranged at the left and right side walls of the housing 301, and the cover 302 is connected to the housing 301 via the pivots and pivot holes, which form a hinge-type structure.

Figure 6:
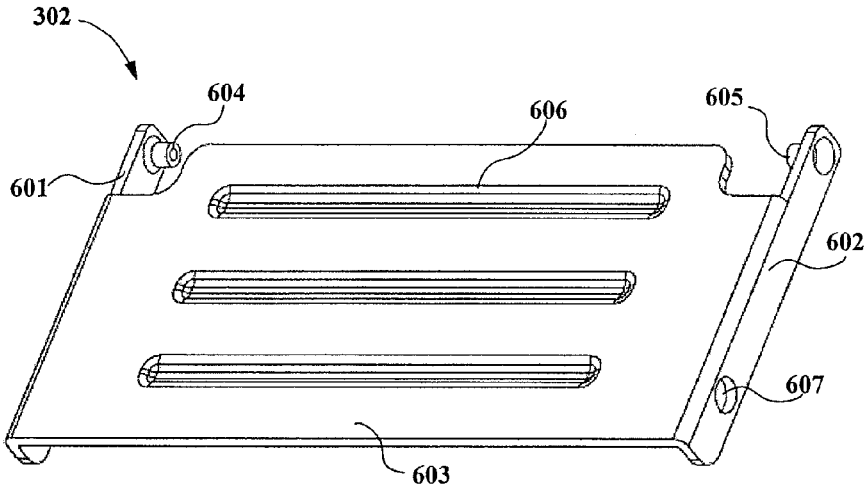
FIG. 6 is a schematic diagram of the cover of the circuit board connector of an embodiment of the present invention.

FIG. 6 is a schematic diagram of the cover 302 of an embodiment of the present invention. As shown in FIG. 6, a top wall 603 (designated 302T in FIG. 5) is arranged between the left side wall 601 and right side wall 602 of the cover 302. One end of the left side wall 601 and one end of the right side wall 602 is provided with a pivot 604 and pivot 605, respectively.

Furthermore, as shown in FIG. 6, ribs 606 may be provided on the top wall 603. In implementation, a plurality of ribs 606 may be provided at the outer side of the top wall 603, thereby facilitating a user to push the cover 302; and a plurality of ribs (not shown) may be provided at the inner side of the top wall 603, thereby increasing the contacting force with the circuit board, preventing the circuit board from being disengaged.

Figure 7:
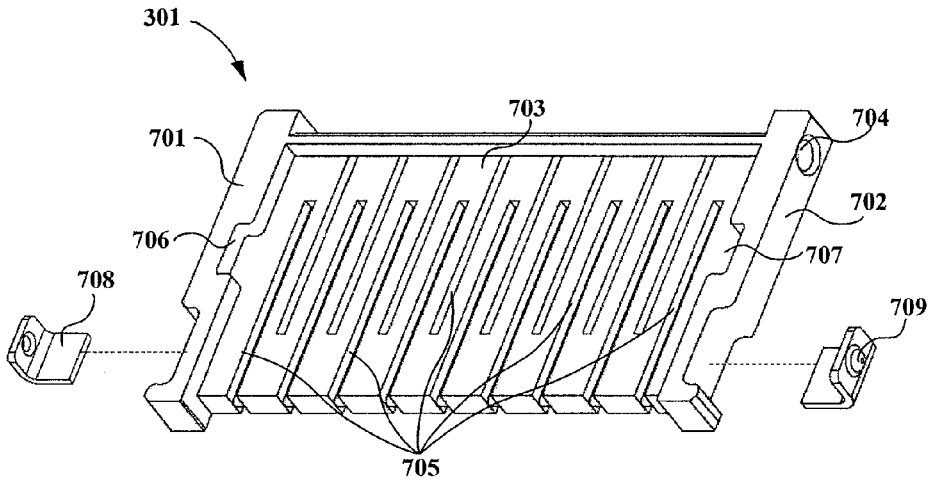
FIG. 7 is a schematic diagram of the housing of the circuit board connector of an embodiment of the present invention.

FIG. 7 is a schematic diagram of the housing 301 of an embodiment of the present invention. As shown in FIG. 7, a bottom wall 703 (designated 301B in FIG. 5) is arranged between the left side wall 701 (designated 301L in FIG. 3) and right side wall 702 (designated 301R in FIG. 3) of the housing 301. One end of the left side wall 701 and one end of the right side wall 702 is provided with a pivot hole (see the pivot hole 704 in FIG. 7, and the other pivot hole is not shown in FIG. 7), respectively.

As shown in FIG. 7, there may be a plurality of bottom slots 705 (only schematically shown) on the bottom wall 703 which are used for arranging the contact pins 304.

Furthermore, as shown in FIG. 7, a guiding hole (recess) 706 may be arranged on the left side wall 701 of the housing 301, and a guiding hole (recess) 707 may be arranged on the right side wall 702 of the housing 301. The circuit board may be fixed via the guiding holes 706 and 707, so as to prevent the circuit board from moving.

In an embodiment, the locking device 303 may include a locking hole and a locking block. As shown in FIG. 6, the locking hole 607 may be arranged at an end of the cover 302 opposite to the pivot 605 and positioned on the right side wall 602 of the cover 302; and the other locking hole (not shown) may be arranged at another end of the cover 302 opposite to the pivot 604 and positioned on the left side wall 601 of the cover 302.

As shown in FIG. 7, the locking block 709 may be arranged at an end of the housing 301 opposite to the pivot hole 704 and positioned on the right side wall 702 of the housing 301; and the locking block 708 may be arranged at an end of the housing 301 opposite to another pivot hole (not shown) and positioned on the left side wall 701 of the housing 301.

In implementation, the circuit board extends into the accommodation space 305 of the circuit board connector 300, and after the cover 302 is closed, the locking block of the housing 301 is embedded into the locking hole of the cover 302, thus locking the cover 302.

The locking device is described above taking a locking block and a locking hole as an example. However, it is not limited thereto, an existing hinge lock, etc. may be used, and a particular structure may be determined as actually demanded.

In an embodiment, one end of the contact pins 304 may be of a convex structure. The convex structure may include an arc convex shape or a semi-circular convex shape, and the size of the arc convex shape being different from that of the semi-circular convex shape.

Figure 8A:
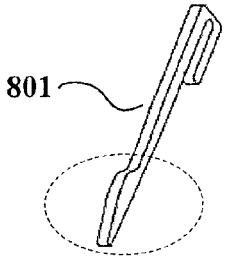
FIGS. 8A and 8B are schematic diagrams of contact pins of the circuit board connector of an embodiment of the present invention.
Figure 8B:
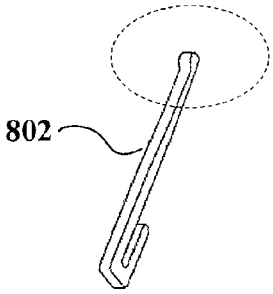

FIGS. 8A and 8B are schematic diagrams of contact pins of an embodiment of the present invention. As shown in FIGS. 8A and 8B, the contact pins may comprise, respectively, a contact pin 801 and a contact pin 802 with different shapes; wherein one end of the contact pin 801 has an arc convex shape, and the contact pin 802 has a semi-circular convex shape.

In an embodiment, the contact pins having the arc convex shape portion and the contact pins having the semi-circular convex shape portion may be arranged in an alternating way.

Figure 9:
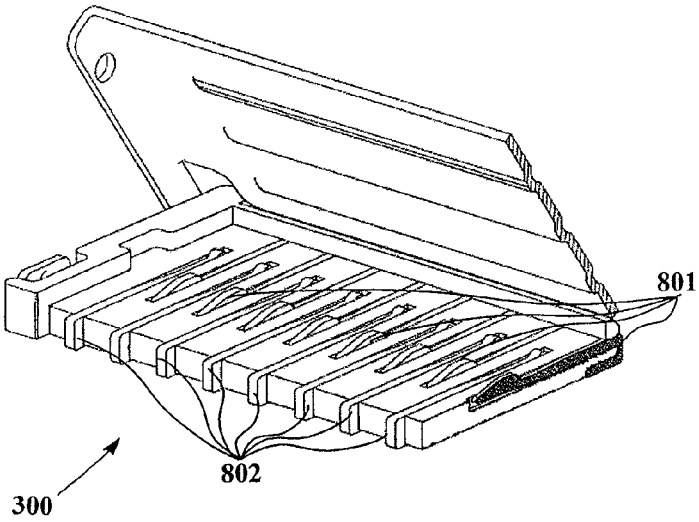
FIG. 9 is a cross sectional view of the contact pin of an embodiment of the present invention having an arc convex structure.
Figure 10:
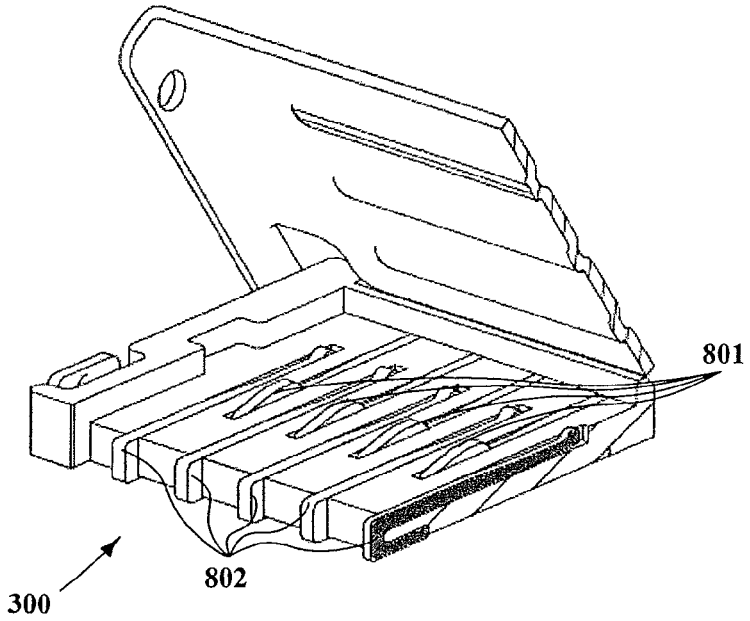
FIG. 10 is a cross sectional view of the contact pin of an embodiment of the present invention having a semi-circular convex structure.

FIG. 9 is a cross sectional view of the contact pins of an embodiment of the present invention having an arc convex shape portion, and FIG. 10 is a cross sectional view of the contact pins of an embodiment of the present invention having a semi-circular convex shape portion. As shown in FIGS. 9 and 10 (only schematically), the contact pins 801 having the arc convex shape and the contact pins 802 having the semi-circular convex shape are arranged in an alternating way in the circuit board connector 300.

Furthermore, as shown in FIGS. 9 and 10, the contact pins 801 having the arc convex are arranged from the right to the left, and the contact pins 802 having the semi-circular convex are arranged from the left to the right.

The above is only schematic description of the shapes of the convexes on the contact pins and the manners of arrangement of the contact pins. However, they are not limited thereto, and particular shapes or manners of arrangement may be determined as actually demanded.

Therefore, after the circuit board extends into the accommodation space of the circuit board connector, the circuit board may further be buckled by the convexes. Furthermore, the force for buckling the circuit board may be further strengthened since the contact pins having the arc convex shape and the contact pins having the semi-circular convex shape are arranged in an alternating way.

In still another embodiment, the circuit board connector may further include guiding slots. The guiding slots are arranged on the left and right side walls of the housing 301 and in communication with the pivot holes. The cover 302 may be slidable along the guiding slots via the pivots.

Figure 11:
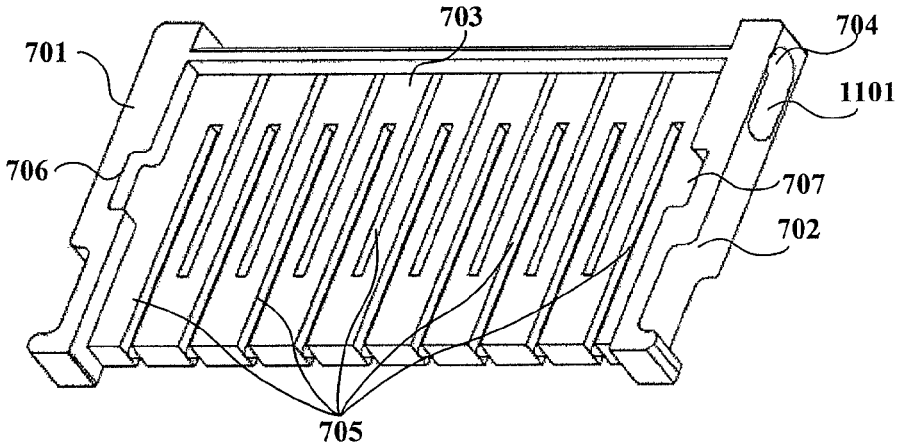
FIG. 11 is another schematic diagram of the housing of the circuit board connector of an embodiment of the present invention.

FIG. 11 is another schematic diagram of the housing of an embodiment of the present invention. As shown in FIG. 11, the housing 301 of the circuit board connector may further include a guiding slot 1101 in communication with the pivot hole 704 and another guiding hole (not shown) in communication with another pivot hole. The pivot 605 of the cover 302 may be embedded into (inserted or within) the guiding slot 1101, the pivot hole 604 may be embedded into (inserted or within) the other guiding slot, and the cover 302 may be slidable along these two guiding slots via the pivots 604 and 605.

Therefore, the cover 302 may be flat pushed via the guiding slots after it is closed. The sliding of the cover 302 along the guiding slots via the pivots may cause the locking block to be disengaged from the locking hole, thereby unlocking the cover 302. Then the cover 302 may be opened to eject the circuit board.

It can be seen from the above embodiment that not only the reliable connection of the circuit board can be realized via the circuit board connector having a locking structure, without a gasket or a film, but also the circuit board can be locked firmly, preventing the rebounding of the hinge of the connector.

Figure 12:
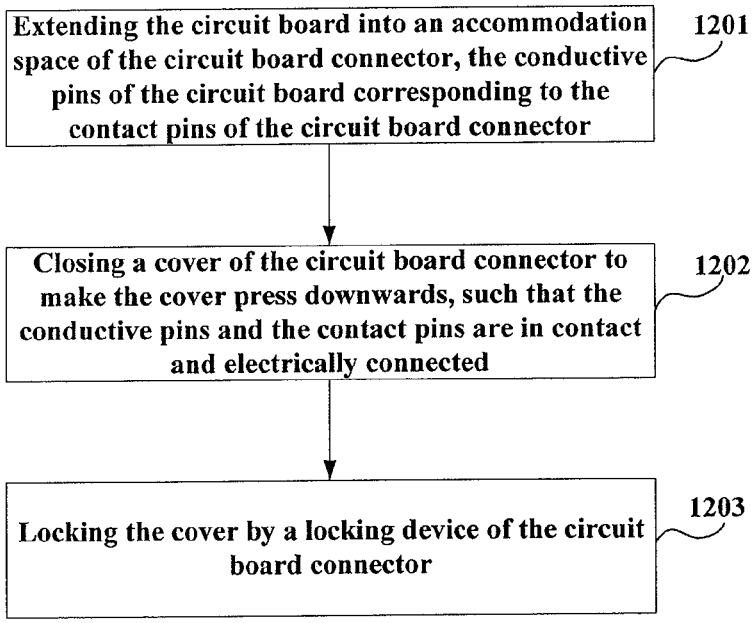
FIG. 12 is a flowchart of the method for connecting of an embodiment of the present invention.

The embodiments of the present invention further provide a method for connecting a circuit board, using the circuit board connector as stated above. FIG. 12 is a flowchart of the method for connecting of an embodiment of the present invention. As shown in FIG. 12, the method for connecting includes:

Step 1201: extending the circuit board into an accommodation space of the circuit board connector, the conductive pins of the circuit board corresponding to the contact pins of the circuit board connector;

Step 1202: closing a cover of the circuit board connector to make the cover press downwards, such that the conductive pins and the contact pins are in contact and electrically connected; and Step 1203: locking the cover by a locking device of the circuit board connector.

Therefore, not only the reliable connection of the conductive pins can be realized, but also the circuit board can be locked firmly, preventing the rebounding of the hinge of the connector.

Figure 13:
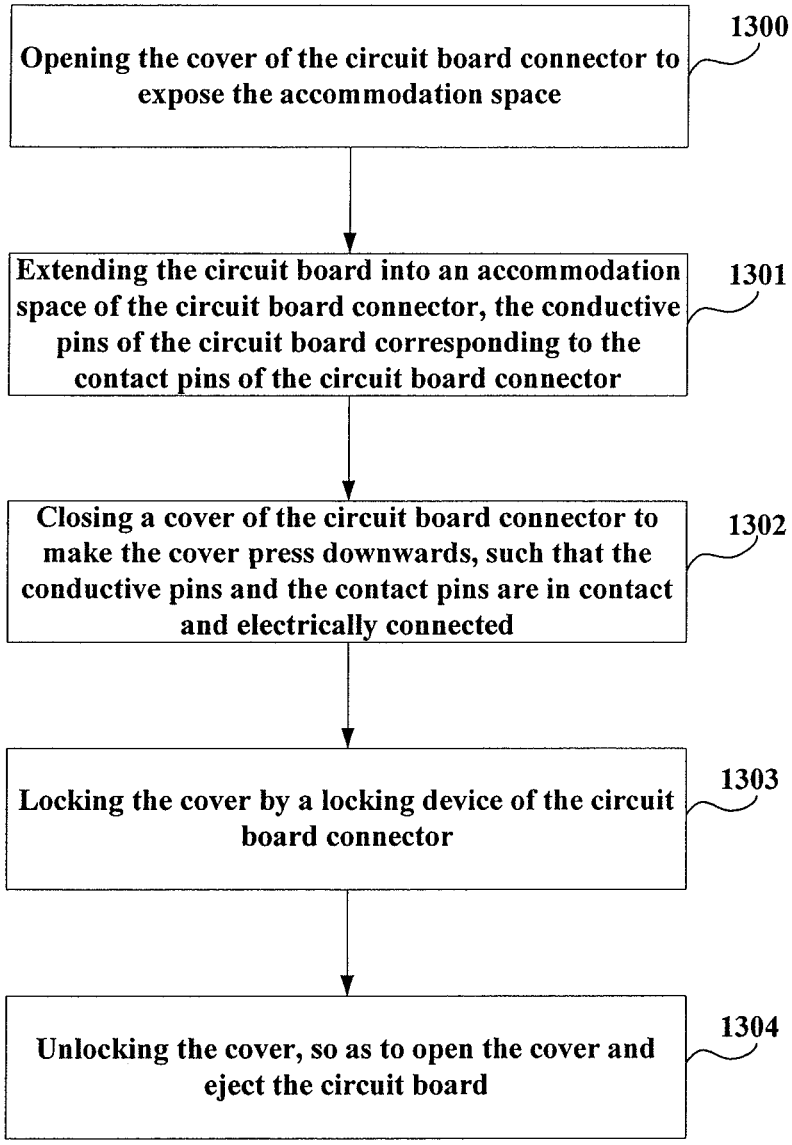
FIG. 13 is another flowchart of the method for connecting of an embodiment of the present invention.

FIG. 13 is another flowchart of the method for connecting of an embodiment of the present invention. As shown in FIG. 13, the method for connecting includes:

Step 1301: extending the circuit board into an accommodation space of the circuit board connector, the conductive pins of the circuit board corresponding to the contact pins of the circuit board connector;

Step 1302: closing a cover of the circuit board connector to make the cover press downwards, such that the conductive pins and the contact pins are in contact and electrically connected; and Step 1303: locking the cover by a locking device of the circuit board connector.

As shown in FIG. 13, before step 1301, the method for connecting further includes:

Step 1300: opening the cover of the circuit board connector to expose the accommodation space.

In an embodiment, step 1303 may specifically include: embedding a locking block of the locking device into the locking hole of the locking device, so as to lock the cover.

In an embodiment, step 1302 may further include: buckling the circuit board by the ribs on the cover.

In another embodiment, step 1302 may further include: fixing the circuit board by the guiding holes on the housing of the circuit board connector, so as to prevent the circuit board from moving.

As shown in FIG. 13, after step 1303, the method for connecting may further include:

Step 1304: unlocking the cover, so as to open the cover and eject the circuit board.

In particular, step 1304 may include: pushing the cover, and the cover sliding along guiding slots arranged on the housing of the circuit board connector, such that the locking block of the locking device disengages from the locking hole of the locking device to unlock the cover.

It can be seen from the above embodiment that not only the reliable connection of the circuit board can be realized via the circuit board connector having a locking structure, without a gasket or a film, but also the circuit board can be locked firmly, preventing the rebounding of the hinge of the connector.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

The description or blocks in the flowcharts or of any process or method in other manners may be understood as being indicative of including one or more modules, segments or parts for realizing the codes of executable instructions of the steps in specific logic functions or processes, and that the scope of the preferred embodiments of the present invention comprise other implementations, wherein the functions may be executed in manners different from those shown or discussed, including executing the functions according to the related functions in a substantially simultaneous manner or in a reverse order, which should be understood by those skilled in the art to which the present invention pertains.

The logic and/or steps shown in the flowcharts or described in other manners here may be, for example, understood as a sequencing list of executable instructions for realizing logic functions, which may be implemented in any computer readable medium, for use by an instruction executing system, device or apparatus (such as a system including a computer, a system including a processor, or other systems capable of extracting instructions from an instruction executing system, device or apparatus and executing the instructions), or for use in combination with the instruction executing system, device or apparatus.

Various features of the present invention are illustrated above by way of literal description and drawings. It should be understood that those skilled in the art may prepare appropriate computer codes to realize the each of the steps and procedures described and illustrated above. It should be also understood that various terminals, computers, servers and networks described above may be of any type, and the computer codes may be prepared according this disclosure to realize the present invention by using the devices.

Particular embodiments of the present invention are disclosed herein. It is readily conceivable to those skilled in the art that the present invention is applicable in other environments. Actually, there exist many embodiments and implementations. The appended claims are in no way to limit the scope of the present invention to the particular embodiments above. Furthermore, any quotation of "a device for . . . " is to describe the explanations of the devices plus functions of the elements and claims, and any quotation with no "a device for . . . " of the elements is no intended to be understood as an element of devices plus functions, even though the wording of "device" is contained in the claims.

Although the present invention is described by way of particular embodiment or embodiments, it is obvious that equivalent modifications and variants are conceivable to those skilled in the art. Especially for various functions executed by the above elements (parts, assemblies, devices, and compositions, etc.), it is expected that the terms describing these elements (including the quotation of "device") correspond to any element executing the particular functions (i.e. functional equivalents) of these elements, except otherwise specified, even though the structure of this element is different from the disclosed structure executing these functions in the exemplary embodiment or embodiments illustrated in the present invention. Furthermore, although the particular features of the present invention by way of description of only one or more of the illustrated embodiments, these features may be combined with one or more of the features of other embodiments as required and in consideration of advantages of any specific or particular applications.

The invention claimed is:

1. A circuit board connector, comprising:

a housing, comprising a left side wall and a right side wall opposite to each other and a bottom wall arranged between the left and right side walls, the bottom wall being provided with a plurality of contact pins, and the left and right side walls and the bottom wall forming an accommodation space for accommodating the circuit board;

a cover, one end of which being connected to the housing, so that the cover may be opened or closed relative to the housing, wherein:

the cover comprises a left side wall and a right side wall opposite to each other and a top wall arranged between the left and right side walls, and pivots are arranged at the left and right side walls of the cover, pivot holes are arranged at the left and right side walls of the housing, and the cover is connected to the housing via the pivots and pivot holes; and a locking device arranged on the housing and the cover, the locking device locking the cover when the cover is closed, wherein the locking device comprises:

a locking hole arranged at an end of the cover opposite to the pivots and positioned on the left and right side walls of the cover; and a locking block arranged at another end of the cover opposite to the pivot holes and positioned on the left and right side walls of the housing.

2. The circuit board connector according to claim 1, wherein the cover has ribs at the top wall.

3. The circuit board connector according to claim 1, wherein there are guiding holes on the left and right side walls of the housing.

4. The circuit board connector according to claim 1, wherein one end of a contact pin has a convex structure.

5. The circuit board connector according to claim 4, wherein the convex structure comprises an arc convex or a semi-circular convex, and the size of the arc convex is different from that of the semi-circular convex.

6. The circuit board connector according to claim 5, wherein the contact pins having the arc convex and the contact pins having the semi-circular convex are arranged in an alternating way.

7. The circuit board connector according to claim 1, wherein the circuit board connector further comprises:

guiding slots arranged on the left and right side walls of the housing and being in communication with the pivot holes, the cover being slidable along the guiding slots via the pivots.

8. A method for connecting a circuit board, using the circuit board connector as claimed in claim 1, the method for connecting comprising:

an extending step: extending the circuit board into an accommodation space of the circuit board connector, the conductive pins of the circuit board corresponding to the contact pins of the circuit board connector;

a closing step: closing a cover of the circuit board connector to make the cover press downwards, such that the conductive pins and the contact pins are in contact and electrically connected; and a locking step: locking the cover by a locking device of the circuit board connector.

9. The method for connecting according to claim 8, wherein before the extending step, the method further comprises:

an opening step: opening the cover to expose the accommodation space, such that the circuit board extends into the accommodation space.

10. The method for connecting according to claim 8, wherein the locking step comprises: fitting a locking block of the locking device into a locking hole of the locking device, so as to lock the cover.

11. The method for connecting according to claim 8, wherein the cover has ribs at the top wall, and the closing step further comprises: buckling the circuit board by the ribs on the cover.

12. The method for connecting according to claim 8, wherein the right and left side walls of the housing have guiding holes, and the closing step further comprises: fixing the circuit board by the guiding holes on the housing of the circuit board connector, in order to prevent the circuit board from moving.

13. The method for connecting according to claim 8, wherein after the closing step, the method for connecting further comprises:

an unlocking step: unlocking the cover, so as to open the cover and eject the circuit board, and wherein the unlocking step comprises: pushing the cover, and the cover sliding along guiding slots arranged on the housing of the circuit board connector, such that the locking block of the locking device disengages from the locking hole of the locking device to unlock the cover.

14. The method for connecting according to claim 13, wherein the unlocking step comprises:

pushing the cover, and the cover sliding along guiding slots arranged on the housing of the circuit board connector, such that the locking block of the locking device disengages from the locking hole of the locking device to unlock the cover.

15. The circuit board connector according to claim 1, wherein the circuit board connector further comprises:

guiding slots arranged on the left and right side walls of the housing and being in communication with the pivot holes, the cover being slidable along the guiding slots via the pivots.

* * * * *